United States Patent [19]

Anderson

[11] 4,432,435

[45] Feb. 21, 1984

[54] CLAMPING DEVICE

[76] Inventor: Carl Anderson, 12 St. Stephens Pl., Staten Island, N.Y.

[21] Appl. No.: 255,631

[22] Filed: Apr. 20, 1981

Related U.S. Application Data

[63] Continuation-in-part of Ser. No. 143,506, Apr. 24, 1980.

[51] Int. Cl.[3] ..... E04G 7/10

[52] U.S. Cl. ..... 182/82; 182/229

[58] Field of Search ..... 182/82, 229, 214; 248/225.3, 226.3, 316 C, 228, 72; 24/243 B, 263 A

[56] References Cited

U.S. PATENT DOCUMENTS

| | | | |
|---|---|---|---|
| 1,528,268 | 3/1925 | Schlegel | 182/187 |
| 1,839,781 | 1/1932 | Zimmersbach | 24/243 B |
| 3,120,878 | 2/1964 | Negley | 182/82 |

FOREIGN PATENT DOCUMENTS

| | | | |
|---|---|---|---|
| 595281 | 6/1959 | Italy | 52/632 |
| 627324 | 10/1961 | Italy | 182/93 |

OTHER PUBLICATIONS

Builders' Patent Scaffolding Company, p. 6—A Pole Splice Clamp.

*Primary Examiner*—Reinaldo P. Machado
*Assistant Examiner*—Alvin Chin-Shug

[57] ABSTRACT

A clamping device for securing a pole within a U-shaped yoke having a plate member with a hook at one end and a tooth at the other end for respectively engaging opposing slots at the distal ends of the yoke to transversely position the plate across the yoke. A bolt threadingly passes through a hole in the plate to extend in a forward direction on the plate. A bearing plate is rotatably mounted on the forward end of the bolt for abutting the pole and clamping it within the yoke.

8 Claims, 5 Drawing Figures

CLAMPING DEVICE

RELATIONSHIP TO OTHER APPLICATIONS

This invention is a continuation-in-part application of Ser. No. 143,506 filed on 4/24/80 by the present inventor for an invention entitled Pump Jack Poles.

BACKGROUND OF THE INVENTION

This invention relates to a clamping device and more particularly to a clamp for securing a pump jack pole to a wall or roof brace, and the like.

In connection with scaffolding equipment, there is generally utilized a number of upright poles on which ride pump jacks which in turn support horizontal scaffolding. Such equipment is generally utilized in the construction field and especially in connection with the installation of exterior siding on housing structures and especially aluminum siding.

Typically, for the upright poles there has been utilized a pair of wooden 2 by 4's, usually of Douglas fir. The pair of 2 by 4's are coupled together to form a single unitary upright pole. In the aforementioned parent application, there is described a novel aluminum upright pole which has a rubberized coating on one side thereof and serves a similar purpose for utilization as a pump jack pole.

When assembling the scaffolding unit, the upright poles must be secured to the wall or roof of the housing structure on which the scaffolding is placed. For such purposes, there is typically utilized a V-shaped brace with hinged foot locks on the feet of the brace for attachment to the building structure. At the head of the brace, one of the V-shaped members typically supports side links. The two side links in conjunction with the brace member form a U-shaped yoke which fits around the substantially square upright pole. Typically, at the distal ends of the side links of the yoke there are slots. A bolt is inserted through the slot transversely across the distal ends of the yoke and is held in place by means of wing nuts.

The prior art clamping arrangement has been found in need of improvement. Firstly, since the bolt fits transversely across the ends of the yoke and is retained by means of wing nuts, there has been found very little leverage for suitably tightening the bolt in place and as a result, frequently the clamping arrangement loosens causing movement of the upright pole and possible accidental collapse of the scaffolding.

In addition, since the wing nut is tightening the bolt in a lateral direction, it has been found that cross threading of the wing nut on the bolt frequently occurred which accordingly damaged the bolt and either prevented its further use, or if it was used it prevented adequate tightening and clamping of the pump jack pole.

With the prior art arrangement, the bolt itself formed a separate piece from the yoke and additionally required other parts to retain the bolt in place. Either wings nuts were utilized at both ends of the bolt, or a wing nut was used at one end and with a hole formed through the bolthead, a nail was placed transversely through the hole to hold the bolt in place. In either case, there were numerous pieces that had to be retained and frequently all of these pieces were not found and resulted in loss of time, failure to adequately clamp the poles, and extra cost to replace parts.

Additionally, and perhaps one of the major problems, since the tightening of the bolt was done in a transverse position with respect to the upright pole, there existed a moment of force during the tightening of the bolt which caused possible rotation of the upright pole during clamping. Also, since the clamping was achieved by pulling the two links together, the pole was only held in place on its two sides, but was not fully held in place on its opposing two sides since the bolt was necessarily spaced from the surface of the pole.

SUMMARY OF THE PRESENT INVENTION

Accordingly, it is an object of the present invention to provide an improved clamp which avoids the aforementioned problems of prior art devices.

Another object of the present invention is to provide a clamping device especially for use in connection with clamping pump jack poles to the yoke of a support brace.

Still another object of the present invention is to provide a clamping device which can securely retain an upright post in position within a U-shaped yoke.

A further object of the present invention is to provide a clamping device which is formed of a single unitary structure and can be secured to the side legs of a U-shaped yoke using one hand operation.

Still a further object of the present invention is to provide a clamping device which retains an upright post within a U-shaped clamp by clamping directly against the post thereby stabilizing the post while clamping it.

Briefly, in accordance with the present invention, there is provided a clamping device for securing a pole within a U-shaped yoke. The clamping device includes a plate member which has a hole extending therethrough. Coupling mechanisms are provided for coupling the plate member transversely across the distal ends of the U-shaped yoke. A bolt threadingly passes through the hole to extend through a forward surface thereof. A bearing plate is rotatably mounted on the forward end of the bolt and abuts against the pole thereby stabilizing it and clamping it within the yoke.

In an embodiment of the invention, wherein the distal ends of the U-shaped yoke are slotted, the clamping mechanism comprises a hook laterally extending from one end of the plate member which can grasp one slotted yoke end, and a tooth extending from the opposing end of the plate member for engaging the other slotted yoke end. The length of the plate member substantially corresponds to the width of the pole being clamped between the legs of the yoke. The head of the bolt can include an integral wing nut for additional leverage and the plate member can be concavely shaped for additional strength.

The aforedescribed features and advantages of the invention will, in part, be pointed out with particularity and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawing, like reference characters designate like parts.

DESCRIPTION OF THE PREFERRED EMBODIMENTS

Figure 1:
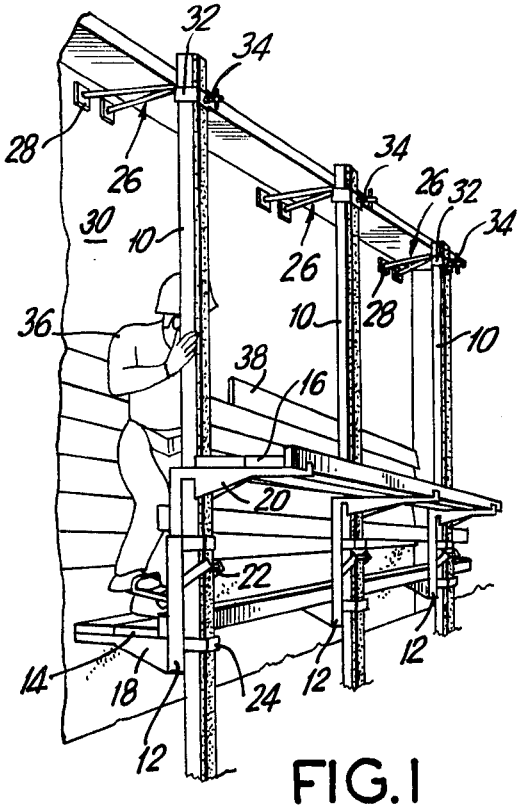
FIG. 1 is a perspective view showing utilization of the clamping device for holding a pump jack pole in place and wherein the pump jack poles are utilized as part of a scaffolding equipment.

Referring now to FIG. 1, there is shown a series of pump jack poles 10 on which are mounted pump jacks 12 which in turn support lateral scaffolding 14, 16 on the arms 18, 20 of the pump jacks. The pump jacks ride up and down the poles by means of the shackles 22, 24. Such pump jack poles and accessory equipment is commonly known in the industry and need not be described in further detail.

In order to stabilize and retain the poles securely in position, a brace 26 is used. As shown, the brace is a wall brace having the feet 28 connected to a wall 30. At the forward end of the brace, there is provided a U-shaped yoke 32 and the pole is held in place by means of the clamp 34 in accordance with the present invention.

As shown, an individual 36 stands on the scaffolding and is utilizing the scaffolding assembly for attaching aluminum siding 38 onto the wall 30 of the housing. However, the use of such scaffolding equipment is well known for other similar types of construction utilization.

Figure 2:
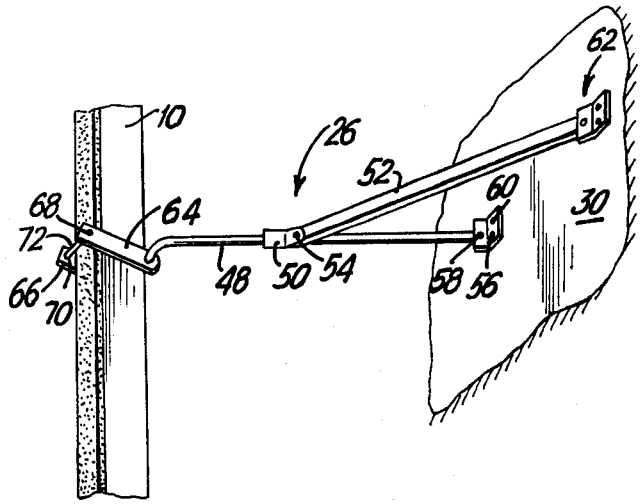
(PRIOR ART) FIG.2
FIG. 2 is a perspective view showing a prior art clamping arrangement for holding a pump jack pole to a wall brace.

Referring now to FIG. 2, there will be shown the prior art device for retaining the pole secured to the brace. As is shown, the brace 26 is formed of a rod 48 on which is fastened a sleeve 50 on which the rod 52 is connected by means of the pivot 54. Typically, the rod 48 is circular in cross section, while the rod 52 has a rectangular cross sectional configuration.

At the end of the rod 48 there is provided a foot 56 which is hinged at 58 and which is fastened to the wall 30 by means of nails or screws 60. A similar foot 62 is pivotally connected at the end of the rod 52.

The forward end of the rod 48 is bent into a perpendicular arm and on which there are placed an opposing pair of side links 64, 66. The side links slide along the extended arm of the rod 48 so that they can be spaced apart a distance to accommodate the pole 10 therebetween.

At the distal ends of the links 64, 66, there are provided slots 68, 70. A bolt 72 is typically utilized to squeeze the two links 64, 66 together and thereby hold the post 10 in place. In utilizing the prior art assembly, the brace is first fastened to the pole by placing the links on either side of the pole. The brace bolt 72 is then slid through one of the slots and a wing nut is placed at its end. The other end of the bolt is then inserted through the other slotted link and locked in place. The locking can be achieved by means of another wing nut. Alternately, a hole can be formed in the bolt head and a nail can be placed through the hole. The wing nuts are then tightened to hold the side links 64, 66 squeezed against the side of the pole 10.

The pole can then be raised to its upright position and the hinged feet 56, 62 are then suitably positioned on the wall or roof of the building.

As can be appreciated, using the prior art arrangement, the wing nuts are tightened onto the bolt. The use of such wing nuts cause cross threading which can damage both the bolt and the nut and prevent its further use. Also, there is little leverage provided with the wing nut, especially when tightening the wing nut transversely across the width of the pole.

A further, and perhaps more serious problem, is that the forward end of the pole is not directly clamped. It is only the sides of the pole that are held in place between the two side links 64, 66. As a result, the U-shaped bracket itself can slide upwardly on the pole, as it is in fact shown in FIG. 2. There is usually a space required between the bolt 72 and the front surface of the pole and this spacing permits movement of the yoke. As a result, the pole is truly not clamped in place in a very secure manner and permits instabilities in the scaffolding equipment.

Figure 3:
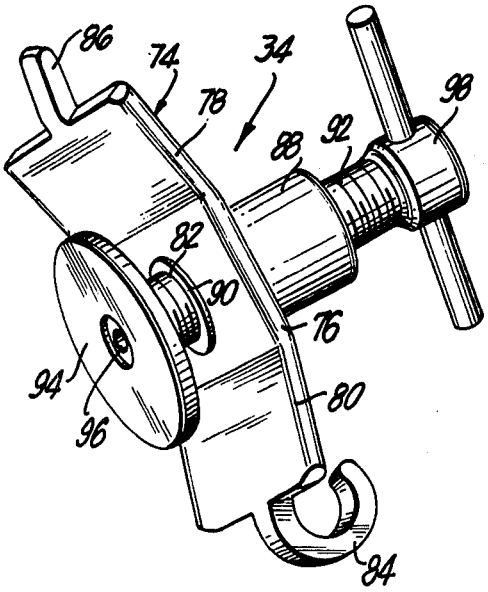
FIG. 3 is a perspective view showing the clamping device in accordance with the present invention.
Figure 4:
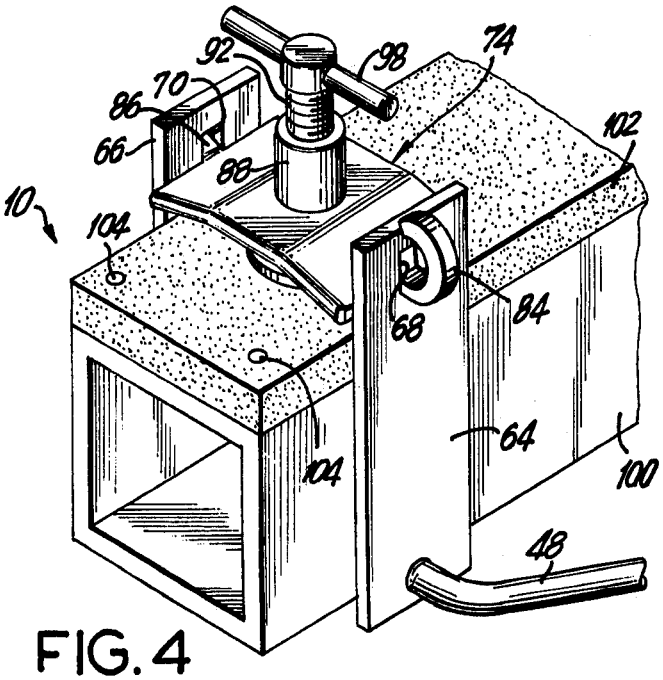
FIG. 4 is a perspective view showing the clamping device of the present invention being utilized in clamping a pump jack pole.
Figure 5:
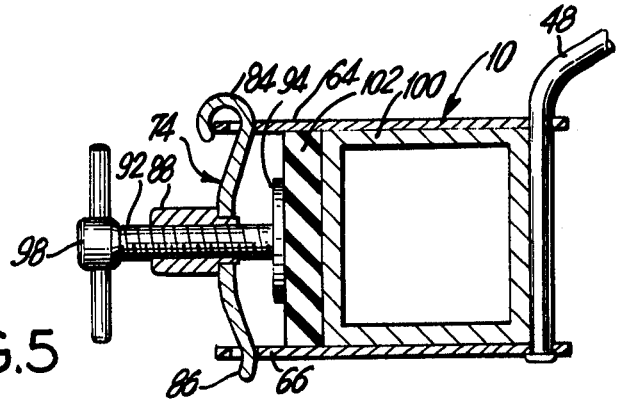
FIG. 5 is a cross sectional view taken through the clamp and pump jack pole.

Referring now to FIGS. 3–5, the improved clamping device of the present invention will now be described.

The clamping device, shown generally at 34, includes a plate member 74 shown as being of a concave shape. Specifically, the plate member includes a substantially flat center section 76 and two laterally inwardly directed sections 78, 80. A hole 82 is formed transversely through the flat portion 76 of the plate member 74.

Laterally extending from one end of the side section 80 is a U-shaped hook member 84 extending rearward of the plate. At the opposing end, and extending from the section 78 is an outwardly extending tooth 86.

An internally threaded stub or post 88 extends rearward from the plate member 74 and is colinearly aligned with the hole 82 formed in the plate member 76. In fact, a part of the post 88 is shown extending through the hole and is peened over on the front end of the plate member as shown at 90.

A bolt 92 is threadingly inserted through the stub 88 and extends forward of the plate member. At the front end, a bearing plate 94 is rotatably pinned to the bolt by means of the pivot pin 96. A wing nut 98 is secured at the head of the bolt 92 to permit rotation of the bolt within the threaded stub 88 so as to adjust the forward extension of the bolt from the plate member 74.

As is noted in FIG. 4, in utilizing the present clamp, the hook 84 is inserted into one of the slots 68 at the distal end of one of the arms 64. The tooth 86 is then inserted into the other slot 70 formed in the distal end of the other link 66. The wing nut 98 is then turned so as to thread the bolt 92 in the stub 88 and press the bearing plate against the post 10. It should be noted, that as the bolt is tightened, it directly presses against the post and thereby clamps the post between the bearing plate 96 and the arm 48. At the same time, by means of the hook and the tooth, the two side links 64, 66 are pulled together and squeezed against the side portions of the post 10. As a result, the post is clamped on all four sides by means of the present invention. This should be noted in contradistinction to the prior art wherein only two sides were clamped in place and the post was free to move between the other two opposing sides.

It should be noted that with the present invention, the clamp is tightened directly against the pole, rather than transversely across the pole, as was done with the prior art device. Accordingly, there is no problem with causing a moment about the arm 48 and as a result there is greater leverage provided in tightening the pole in place and retaining it secure. Also, it should be appreciated that the present clamp is a one piece member which does not have separate parts. As a result, there is no problem of loosing portions of the clamping device. In fact, the hook 84 can actually be closed so that it forms a single unitary assembly with the brace and as a result, is maintained together with the brace. As a result, there is no possibility of loss of parts. Whenever the brace is to be attached to the pole, the clamp is always present and there is no problem of having to look for separate clamping parts.

It should also be appreciated that with the present device one hand tightening of the clamp in place is achieved. Once the pole is placed between the side links forming the yoke, the clamping device can be tightened by means of one hand operation.

Furthermore, because of the positioning of the bolt head 98 away from the brace member, a larger wing nut can be utilized to achieve greater leverage. This permits greater tightening of the clamp. Furthermore, with the present invention, we avoid the problem of cross threading between the portions of the device.

The particular pole that is demonstrated in the invention is that shown in the aforedescribed parent application. Specifically it includes the aluminum pole 100 on which is placed a rubberized surface 102 on one side thereof and is held in place by means of the rivets 104. The present invention wherein the bearing plates abuts against the rubberized surface 102, has been found uniquely beneficial in securely holding the post in place. The bearing plate can move against the rubberized surface and has been found to provide an extremely secure clamp which also stabilized the post. However, it should be appreciated, that the present invention can also be utilized in conjunction with wooden posts of the prior art, and would also hold such post in place.

There has been described heretofore the best embodiments of the invention presently contemplated. However, it is to be understood that various changes and modifications may be made thereto without departing from the spirit of the invention.

I claim:

1. In combination, a U-shaped bracket comprising a pair of opposing side plates extending from a connecting bar, said side plates being relatively movable with respect to each other along said bar, the ends of said side plates remote from said bar being slotted, and a clamping device for securing a rectangularly shaped pole within said bracket, said clamping device comprising, a plate member having a flat central section and forwardly angled side sections on either side thereof, said central section having a hole extending therethrough, a bolt having a forward end threadingly passing through said hole to extend from a forward surface thereof, a bearing plate rotatably mounted on the forward end of said bolt for abutting the pole and pressing it toward said bar, hook means laterally extending from opposing ends of said side sections of said plate member for respectively engaging the slots in said side plates, said hook means being rearwardly angled with respect to said side sections to form a V interconnection therewith, whereby continued threading of said bolt against the pole presses said pole against said connecting bar and simultaneously said V interconnections draw together said side plates to abut the sides of the pole so that the pole is securely retained on all four sides thereof.

2. The combination as in claim 1, wherein said hook means comprises a hook laterally extending from one end of said plate member for grasping one slotted side plate, and a tooth extending from the opposing end of said plate member for engaging the other slotted side plate.

3. The combination as in claim 1, and further comprising an internally threaded stub aligned with said hole and extending in a rearward direction from said plate member, said bolt threadingly extending through said stub.

4. The combination as in claim 1, and further comprising a winged head on the rearward end of said bolt.

5. The combination as in claim 1, wherein said hole is substantially centrally located through said plate member.

6. The combination as in claim 1, wherein said hook means are integrally formed with said plate member.

7. The combination as in claim 1, wherein the length of said plate member substantially corresponds to the width of the pole being clamped.

8. The combination as in claim 1, and comprising a rectangular pole comprising an elongated metal tubing having a rectangular cross sectional configuration and a rubberized surface formed on one side thereof and facing said bolt.

* * * * *